US006551198B2

(12) United States Patent
Huang

(10) Patent No.: US 6,551,198 B2
(45) **Date of Patent: *Apr. 22, 2003**

(54) GOLF CLUB GRIP ASSEMBLY

(76) Inventor: Ben Huang, 19742 Woodlands La., Huntington Beach, CA (US) 92648

( * ) Notice: Subject to any disclaimer, the term of this patent is extended or adjusted under 35 U.S.C. 154(b) by 0 days.

This patent is subject to a terminal disclaimer.

(21) Appl. No.: 09/929,379

(22) Filed: Aug. 13, 2001

(65) Prior Publication Data

US 2002/0025856 A1 Feb. 28, 2002

Related U.S. Application Data

(63) Continuation-in-part of application No. 09/497,750, filed on Feb. 4, 2000, now Pat. No. 6,386,989.

(51) Int. Cl.[7] ..... A63B 53/14

(52) U.S. Cl. ..... 473/300; 473/301; 473/302; 473/409

(58) Field of Search ..... 473/300, 301, 473/302, 305, 298, 551, 552, 549, 568, 559, 409; 16/110.1, 430, 903, DIG. 12; 81/489

(56) References Cited

U.S. PATENT DOCUMENTS 621,993 A 3/1899 Crosier
1,017,565 A 2/1912 Lard
1,665,791 A 4/1928 Novak
1,943,399 A * 1/1934 Smith ..... 273/81
2,941,806 A 6/1960 Stevens
3,070,370 A 12/1962 Steiner
3,252,706 A 5/1966 Rosasco, Sr.
3,311,375 A 3/1967 Onions
3,524,646 A 8/1970 Wheeler
5,145,171 A 9/1992 Head et al.
5,479,074 A 12/1995 Storper
5,513,845 A 5/1996 Sonagere
5,571,050 A * 11/1996 Huang ..... 473/300
5,584,482 A * 12/1996 Huang ..... 273/75
5,620,180 A 4/1997 Hong
5,626,527 A 5/1997 Eberlein
5,671,923 A * 9/1997 Huang ..... 473/300
5,730,662 A 3/1998 Rens
5,797,813 A * 8/1998 Huang ..... 473/549
5,827,129 A * 10/1998 Huang ..... 473/301
5,895,329 A * 4/1999 Huang ..... 473/302
6,386,989 B1 * 5/2002 Huang ..... 473/300

* cited by examiner

*Primary Examiner*—Sebastiano Passaniti
(74) *Attorney, Agent, or Firm*—Fulwider Patton Lee & Utecht, LLP

(57) ABSTRACT

A grip assembly for the handle of a golf club where the grip assembly includes a resilient underlisting sleeve over which is spirally wrapped a resilient strip. The lower end of the underlisting sleeve includes a nipple formed with an upward facing circumferential groove. The lower end of the strip is urged into the confines of the groove to secure the lower end of the strip to the underlisting sleeve.

3 Claims, 5 Drawing Sheets

GOLF CLUB GRIP ASSEMBLY

RELATED U.S. APPLICATION DATA

This application is a continuation in part of Ser. No. 09/497,750 filed Feb. 4, 2000, entitled GOLF CLUB GRIP ASSEMBLY, now U.S. Pat. No. 6,386,989.

BACKGROUND OF THE INVENTION

The present invention relates to an improved grip assembly for golf clubs and other sporting equipment employing handles subject to shock when such devices are impacted.

It is well known that the shock generated by impact between a golf club and a golf ball can adversely effect muscle tissue and arm joints. The energy generated by such impact is usually of high frequency and short duration with rapid decay and which is often known as "impact shock." Tight grasping of a golf club grip to keep it from slipping in a users hands contributes to such impact shock.

Applicant has previously developed resilient grips which successfully reduce or even eliminate impact shock to the muscle and arm joint of the users of golf clubs. See for example U.S. Pat. No. 5,797,813, granted to applicant Aug. 25, 1998. Such earlier grips utilize a polyurethane layer bonded to a felt layer to define a resilient strip, which is spirally wrapped around an underlisting sleeve, with such underlisting sleeve being slipped over the handle portion of a golf club shaft. After the underlisting sleeve has been properly positioned upon the golf club shaft, a synthetic plastic ferrule such as designated 56 in FIG. 18 of my U.S. Pat. No. 5,895,329 secures the grip in place on the handle of the golf club shaft. Alternatively, the lower end of the resilient strip may be secured to the lower end of the underlisting sleeve by a length of finishing tape. Installation of a ferrule is labor intensive, while the use of finishing tape does not provide a high quality commercial image.

SUMMARY OF THE INVENTION

The golf club grip assembly of my present invention eliminates the disadvantages of the afore mentioned synthetic plastic ferrule, or the use of finishing tape between the lower end of the grip and the handle of a golf club shaft, and particularly a putter.

DESCRIPTION OF A PREFERRED EMBODIMENT

Figure 1:
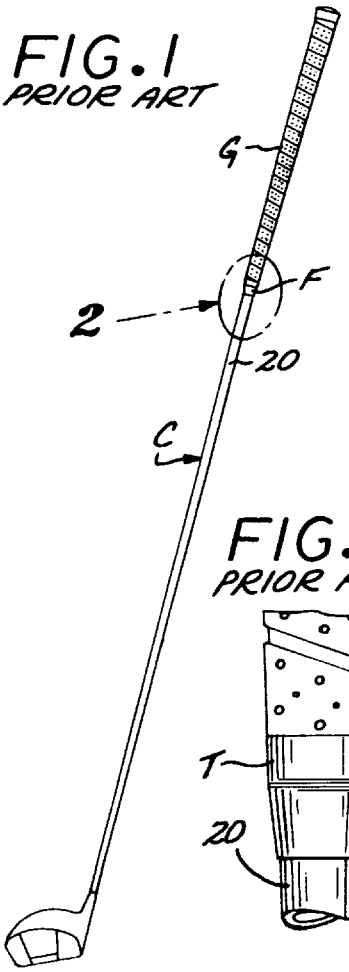
FIG. 1 PRIOR ART
FIGS. 1, 2 and 3 show typical prior art golf club grip assemblies which are subject to the aforementioned disadvantages.
Figure 2:
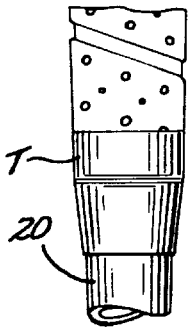
FIG. 2 PRIOR ART
Figure 3:
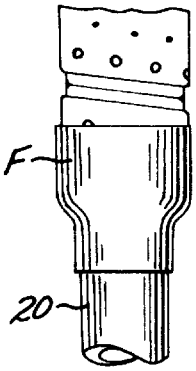
FIG. 3 PRIOR ART
Figure 17:
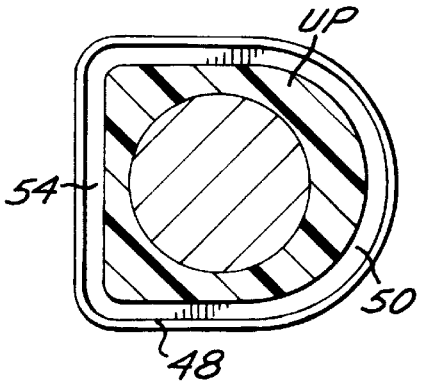
FIG. 17 is a horizontal sectional view taken along line 17—17 of FIG. 16.

Referring to the drawings, FIGS. 1 and 2 show typical prior art golf club grip assemblies wherein the golf club C has a shaft 20 upon the handle portion of which is installed a resilient slip-on grip G provided with a prior art ferrule F that secures the lower end of the grip G to the golf club shaft. FIG. 2 is an enlarged view of the encircled area 2 of FIG. 1. FIGS. 1 and 2 correspond to FIGS. 17 and 18 of my U.S. Pat. No. 5,895,329. Ferrule F is made of an inelastic synthetic plastic material. FIG. 3 is a view similar to FIG. 2 showing a length of finishing tape T spirally wrapped about the lower end of a resilient strip S to secure the lower end of such strip to an underlisting sleeve in accordance with the prior art.

Figure 4:
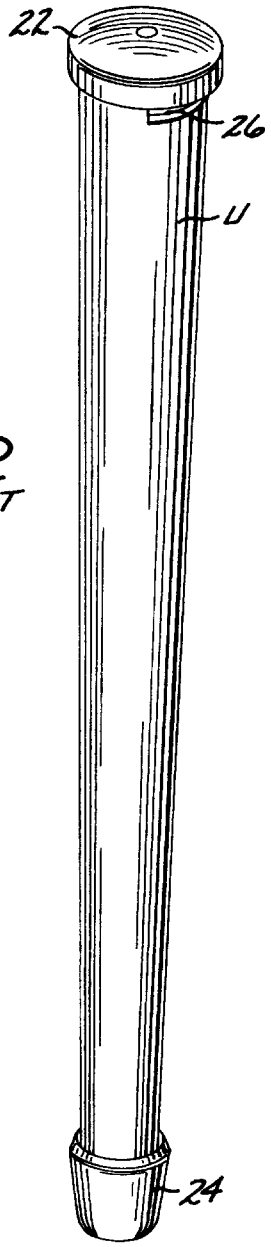
FIG. 4 is a perspective view of an underlisting sleeve of a golf club grip assembly embodying the present invention.
Figure 5:
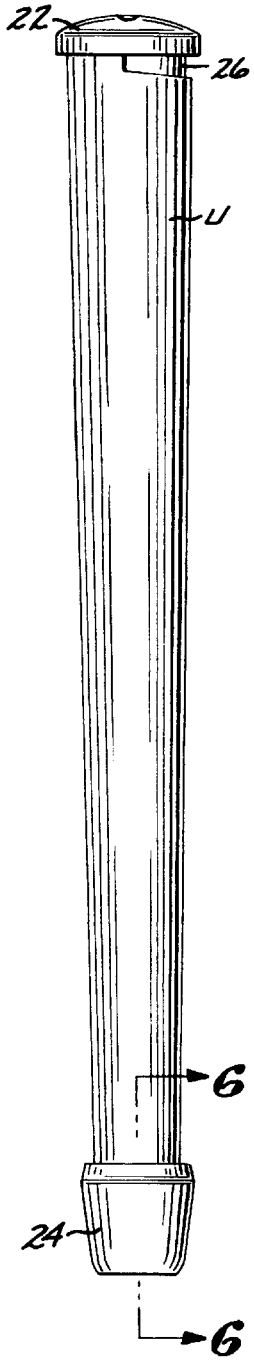
FIG. 5 is a side elevational view of the underlisting sleeve of FIG. 4.
Figure 6:
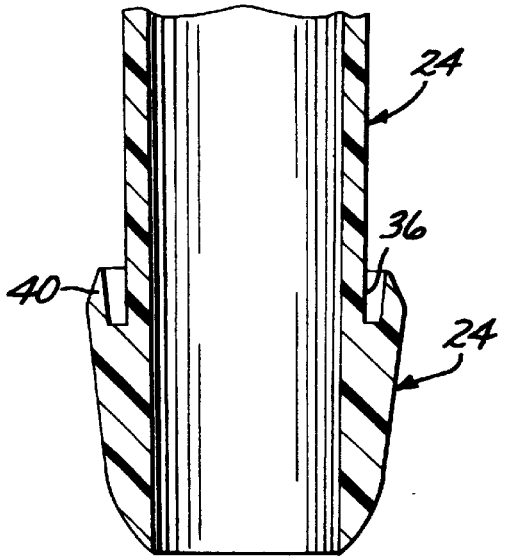
FIG. 6 is a vertical sectional view taken in enlarged scale along line 6—6 of FIG. 5.
Figure 7:
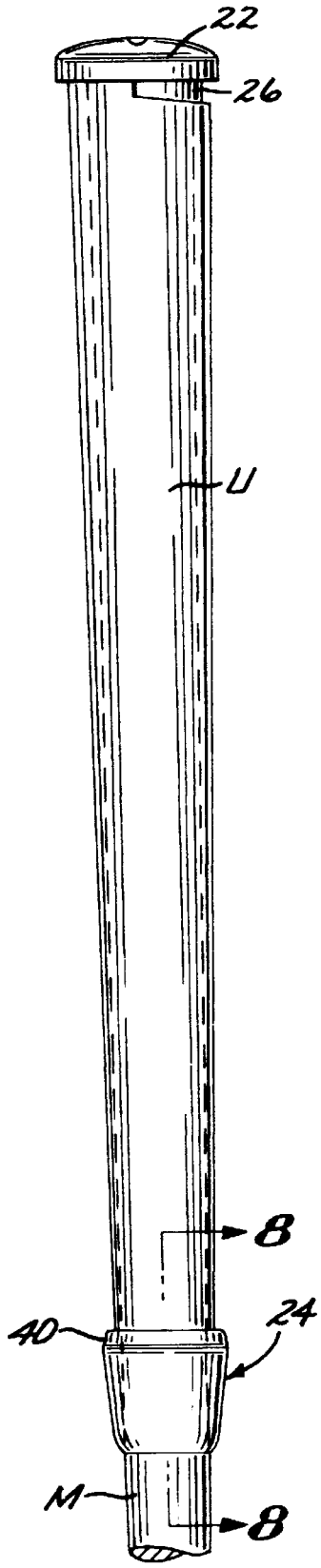
FIG. 7 is a side elevational view of the underlisting sleeve after it has been removable positioned upon a mandrel.
Figure 8:
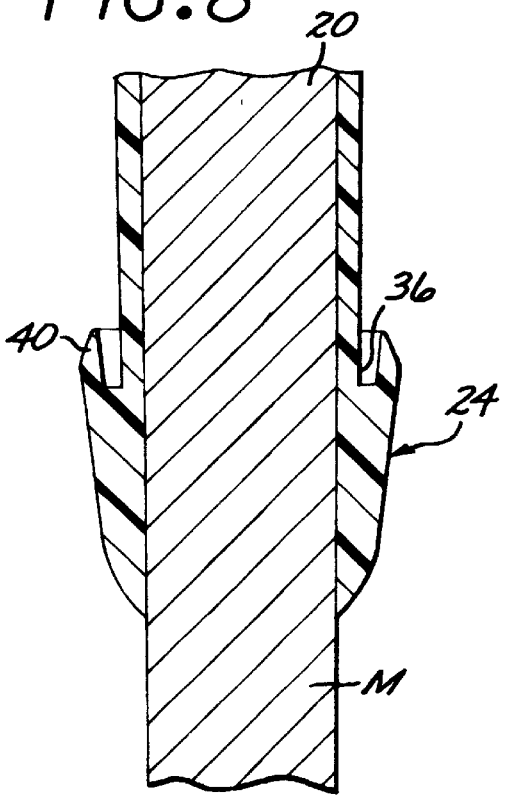
FIG. 8 is a vertical sectional view taken in enlarged scale along 8—8 of FIG. 7.
Figure 9:
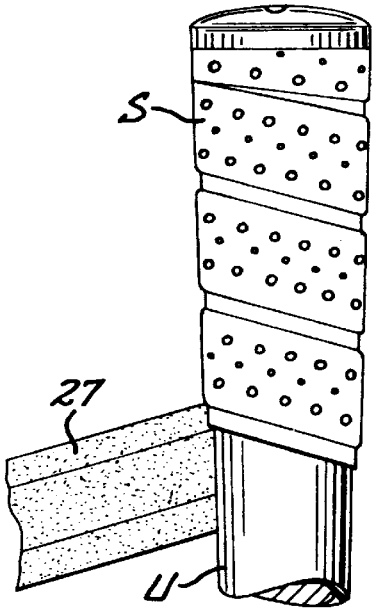
FIG. 9 is a broken side elevational view of a resilient strip being spirally wrapped about the underlisting sleeve.
Figure 10:
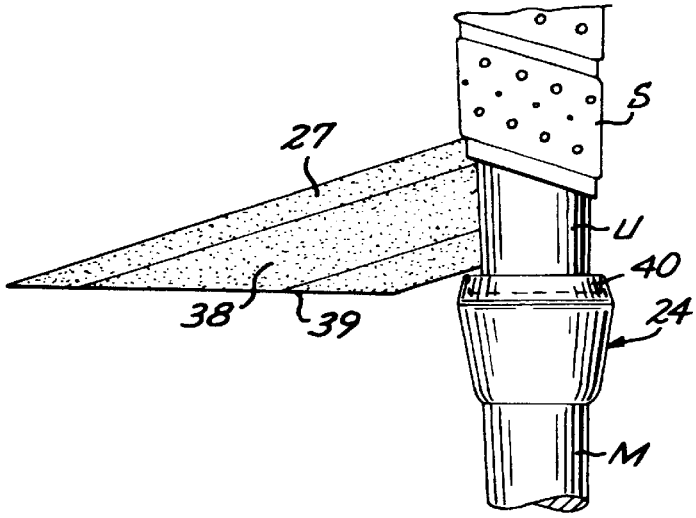
FIGS. 10 and 11 are broken side elevational views the showing the lower portion of the resilient strip being wrapped about the lower end of the underlisting sleeve.
Figure 11:
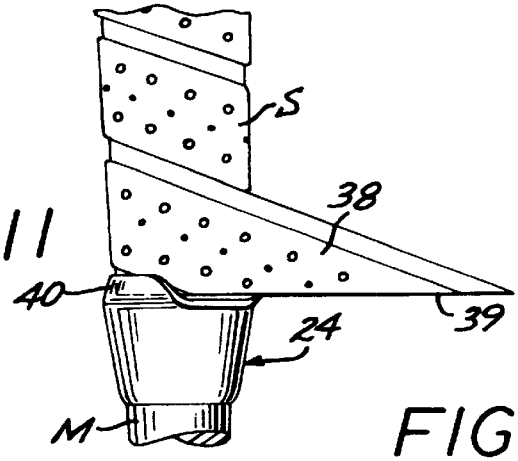
Figure 12:
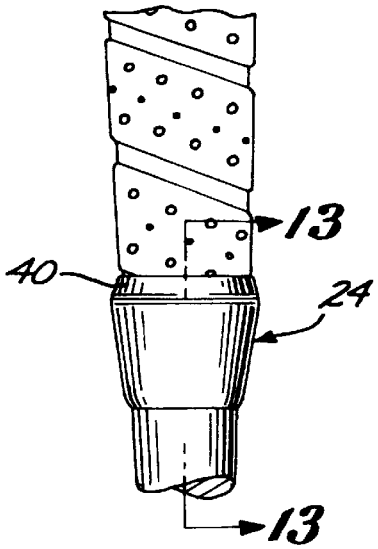
FIG. 12 is a broken side elevational view showing how the lower end of the resilient strip is retained upon the lower end of the underlisting sleeve.
Figure 13:
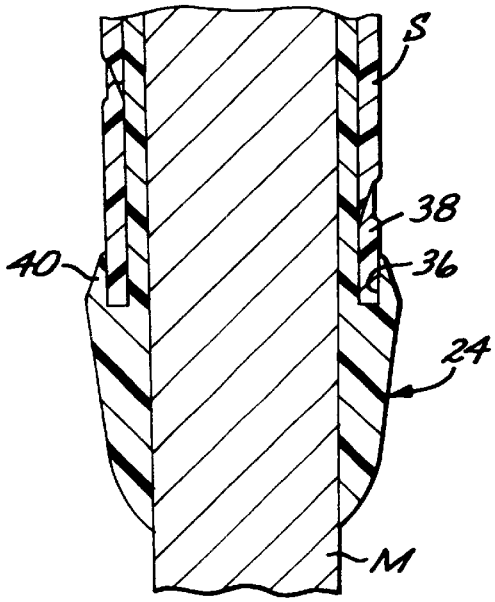
FIG. 13 is a sectional view taken enlarged scale along line 13—13 of FIG. 12.

Referring now to FIGS. 4 and 5, there is shown a resilient underlisting sleeve U employed in my new grip assembly. Such sleeve U is similar to that described in my U.S. Pat. No. 5,797,813 and includes an integral cap 22. The lower end of the sleeve is formed with an integral nipple 24. The upper portion of the sleeve U is formed with a groove 26 to receive the upper tip of a polyurethane-felt strip S, such as that described in my U.S. Pat. No. 5,797,813. Strip S is spirally wrapped about the body of the underlisting sleeve U, as shown in FIGS. 9–13. An adhesive 27 is applied to the underside of the strip. Referring to FIGS. 6, 7 and 8, the upper portion of nipple 24 is formed with an upwardly-facing circumferential groove 36 that receives the lowermost wrap 38 of resilient strip S, as indicated in FIGS. 11, 12, and 13.

In FIGS. 7 and 8, underlisting sleeve U is shown after it has been longitudinally positioned upon a mandrel M. In FIG. 9 the resilient strip S is shown being spirally wrapped about the underlisting sleeve U, starting at the upper end of the underlisting sleeve. In FIG. 10 the lower portion of the strip S is shown after it has been spirally wound to a position wherein its horizontally cut lower edge 39 is disposed in horizontal alignment with the lower portion of nipple groove 36. Thereafter, as indicated in FIG. 11 the lower end portion of the strip is manually urged into the confines of the groove 36 by temporarily expanding the peripheral lip 40 formed outwardly of the groove so as to admit the lower edge of the strip into the groove. When the lip 40 returns to its original position, the lip will securely retain the lower end of the strip to the upper portion of the nipple, as shown in FIGS. 12 and 13. The sleeve and strip combination may then be removed from the mandrel and slipped onto the handle portion of a golf club shaft in a conventional manner.

Figure 14:
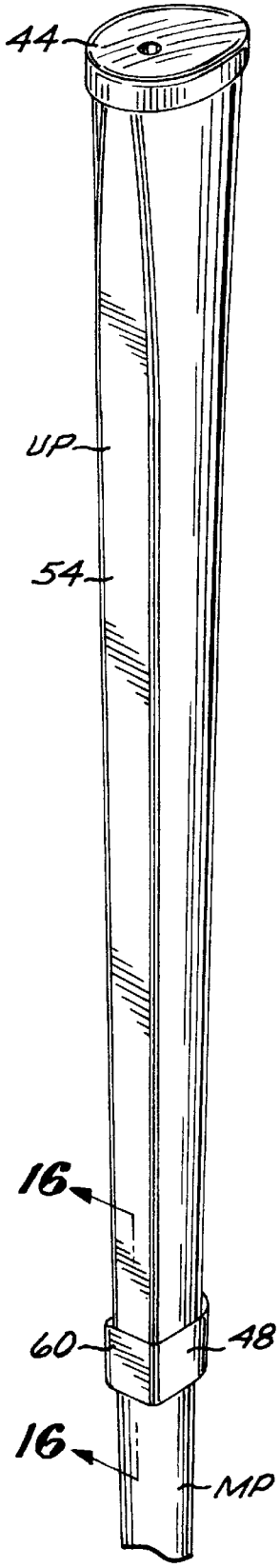
FIG. 14 is a perspective view of an underlisting sleeve of a putter grip assembly embodying the present invention.
Figure 15:
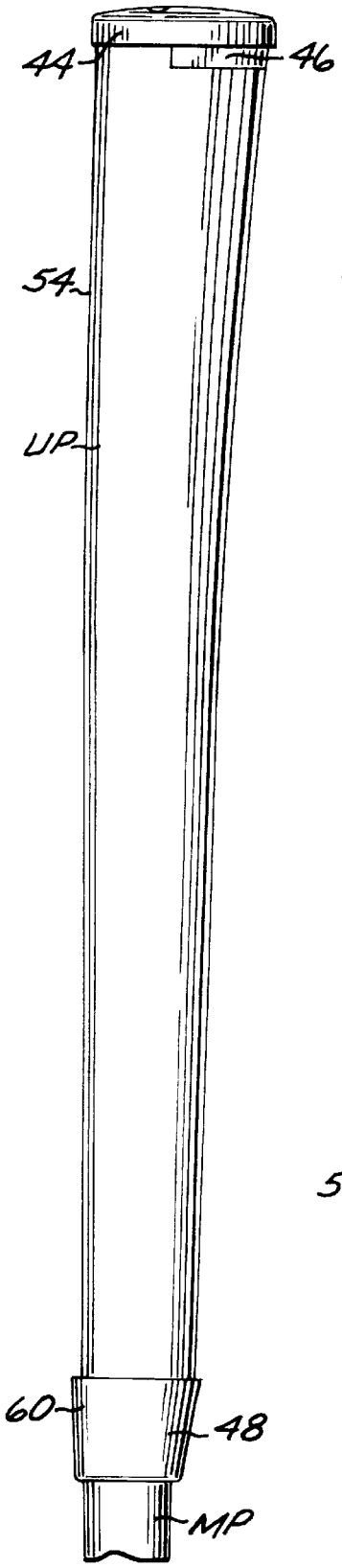
FIG. 15 is a side elevational view of the underlisting sleeve of FIG. 14.
Figure 16:
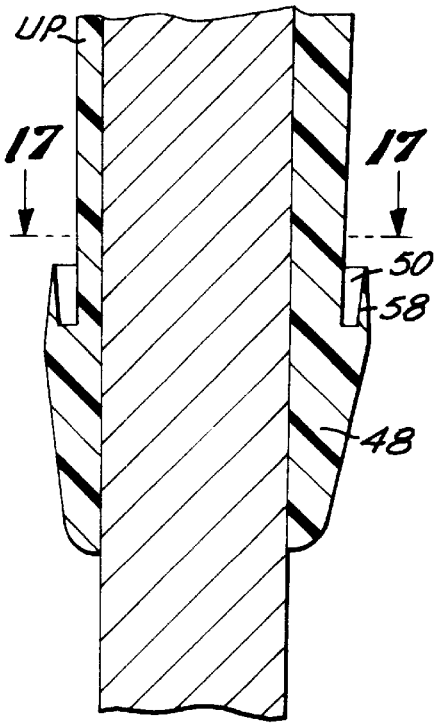
FIG. 16 is a vertical sectional view taken in enlarged scale along line 16—16 of FIG. 14.

Referring now to FIGS. 14–22, there is shown a golf club grip assembly embodying the present invention as directed to a putter. FIGS. 14 and 15 show a putter underlisting sleeve UP. The upper end of such sleeve is provided with an integral collar 44 and a groove 46 to receive the upper tip of a resilient strip such as that described in my U.S. Pat. No. 5,797,813. The lower end of the underlisting sleeve UP is formed with a nipple 48, which is formed with an upwardly-facing circumferential groove 50 that receives the lowermost wrap 52 of resilient strip PS similar in construction to strip S. As will be apparent from the drawings underlisting sleeve is not of an annular configuration such as the underlisting sleeve U shown in FIG. 7. Instead, the front surface 54 of the underlisting sleeve is of flat configuration in accordance with the design of most putters in general use.

Figure 18:
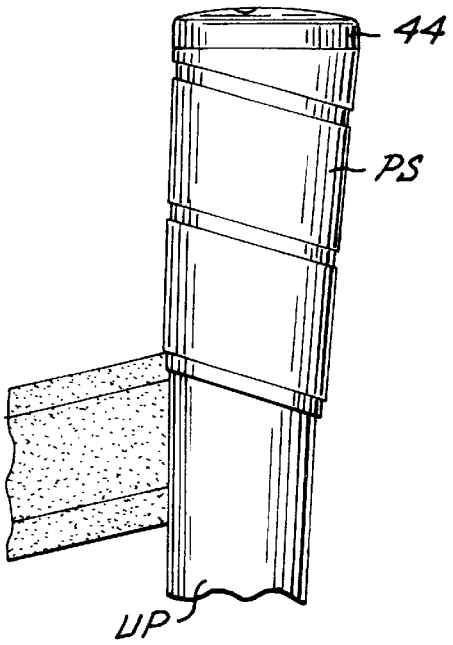
FIG. 18 is a broken side elevational view of a resilient strip being spirally wrapped around the upper portion of the underlisting sleeve.
Figure 19:
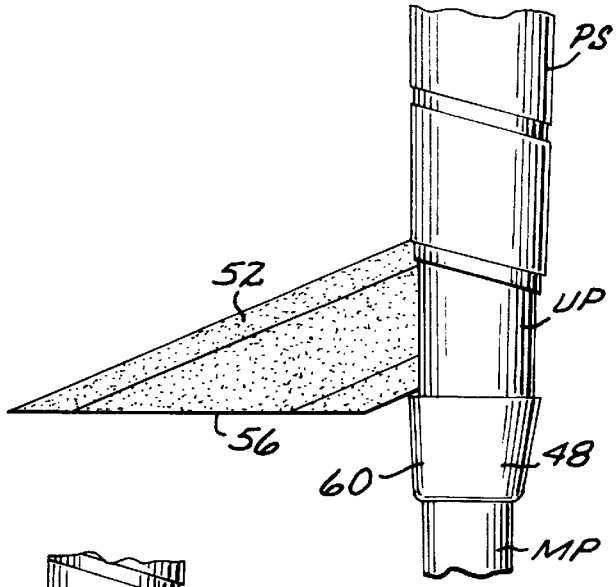
FIG. 19 is a broken side elevational view showing the resilient strip of FIG. 18 being wrapped around the lower portion of the underlisting sleeve.
Figure 20:
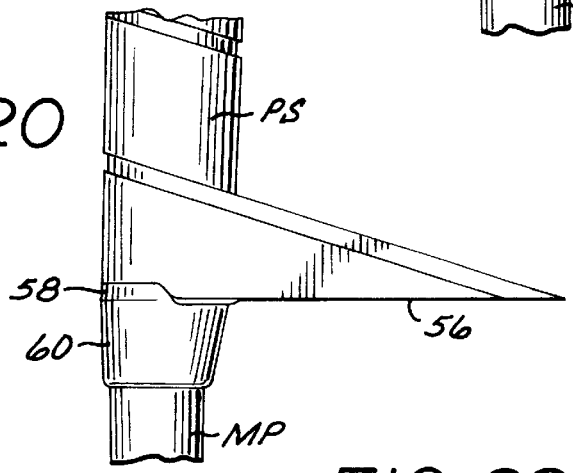
FIG. 20 is a broken side elevational view showing how the lower end of the resilient strip is secured within the nipple of the underlisting sleeve.
Figure 21:
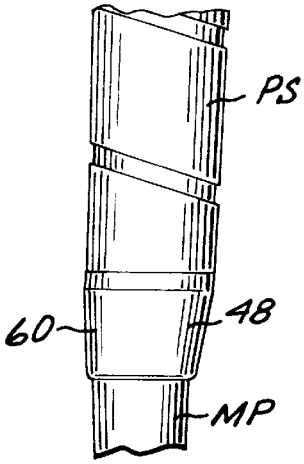
FIG. 21 is a broken side elevational view similar to FIG. 20 showing the resilient sleeve after it has been secured within the underlisting sleeve nipple.
Figure 22:
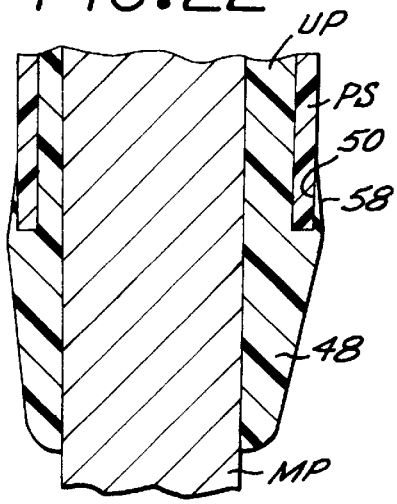
FIG. 22 is a vertical sectional view taken in enlarged scale along line 22—22 of FIG. 21.

Underlisting sleeve UP is shown after it has been longitudinally positioned upon a conventional expandable mandrel MP. In FIG. 18, resilient strip PS is being shown spirally wrapped around the underlisting sleeve UP starting at the upper end of such sleeve. In FIG. 19, the lower portion of the strip PS is shown after it has been spirally wound to a position wherein its horizontally cut lower edge 56 is disposed in horizontal alignment with the lower portion of nipple groove 50. Thereafter, as indicated in FIG. 20, the lower end portion of the strip is manually urged into the confines of the groove 50 by temporarily expanding the peripheral lip 58 defining the outer portion of the circumferential groove so as to admit the lower edge of the strip into the groove. When the lip 58 snaps back to its original position, the lip will securely retain the lower end of the strip to the upper portion of the nipple, as shown in FIGS. 21 and 22.

It should be noted that the provision of a flat front surface 54 of underlisting sleeve UP provides important advantages over the use of an annular underlisting sleeve of the type shown in FIGS. 1–13. In particular, it is easier to install resilient strip PS on the underlisting sleeve UP since it does not require twisting of the circumferential lip to insert the lower edge of the strip within the circumferential groove 50. Additionally, the provision of the flat front face 60 of the nipple 48 continues the straight vertical line of the main body of the underlisting sleeve and hence the resilient strip PS throughout the length of the putter grip. In this manner the putting accuracy of the golfer is enhanced. Also, this arrangement makes it easier for a grip manufacturer to slip the completed grip onto the shaft of a putter.

From the foregoing description it will be apparent that the resilient strips S and PS may be installed on an underlisting sleeve quickly and easily with a minimum amount of expenditure of time and labor by a golf club manufacturer. Moreover, a golf club grip assembly embodying the present invention provides a far more professional appearance that prior art grips utilizing finishing tape and at a lower cost that where finishing tape is utilized. My present grip also eliminates the cost of prior art ferrules and the labor required for their installation by a golf club manufacturer.

It will be understood that various modifications and changes may be made with respect to the above-described embodiment without departing from the scope of the present invention.

What is claimed is:

1. A golf putter grip assembly comprising:

a resilient underlisting sleeve formed at its upper end with a cap and with a first groove below the cap, said sleeve also being formed at its lower end with a nipple and with a front surface of said sleeve and nipple being flat;

an upwardly facing circumferential second groove formed in an upper portion of the nipple, an outer portion of the second groove being defined by a flexible circumferential lip;

a resilient strip spirally wrapped about the underlisting sleeve between an underside of the cap and an lower portion of the nipple, an upper portion of the strip being formed with a tip received by the first groove of the sleeve, the lip being expandable outwardly to receive lower end of the strip within the second groove to firmly retain the lower end of the strip within said second groove; and an adhesive applied to the underside of the strip to adhere the strip to the sleeve.

2. A method of making a golf putter club grip assembly utilizing a frusto-conical mandrel, said method including:

providing a resilient underlisting sleeve formed at its upper end with a cap and at its lower end with a nipple, the nipple having an upwardly facing circumferential groove formed in its upper portion, an outer portion of the groove being defined by a flexible circumferential lip, with the front surface of the underlisting sleeve being flat;

providing a resilient strip;

spirally wrapping the resilient strip about and adhering the strip to the underlisting sleeve between an underside of the cap and a lower portion of the groove of the nipple;

expanding the lip outwardly to receive and to securely retain a lower end of the strip within the groove to thereby secure a lower portion of the strip to a lower portion of the underlisting sleeve;

adhering the strip to the sleeve; and removing the assembled sleeve and strip from the mandrel.

3. A method of making a golf putter grip utilizing a frusto-conical mandrel, said method including:

providing a resilient underlisting sleeve formed at its upper end with a cap and with a first groove below the cap, and at its lower end with a nipple, the nipple having an upwardly facing circumferential second groove formed in its upper portion, an outer portion of the second groove being defined by a flexible circumferential lip, and with a front surface of the underlisting sleeve being flat;

providing a resilient strip formed at its upper end with a tip;

spirally wrapping the resilient strip about the underlisting sleeve between an underside of the cap and a lower portion of the second groove of the nipple, with the tip of the sleeve being disposed in the first groove of the nipple;

expanding the lip outwardly to receive and retain a lower end of the strip within the second groove of the nipple to thereby secure the lower portion of the strip to a lower portion of the underlisting sleeve;

adhering the strip to the sleeve; and removing the assembled sleeve and strip from the mandrel.

* * * * *